US005159912A

United States Patent [19]

Klein et al.

[11] Patent Number: 5,159,912

[45] Date of Patent: Nov. 3, 1992

[54] APPARATUS FOR ELECTRONIC ENGINE CONTROL WITH PERFORMANCE CHECK FOR THE FINAL IGNITION STAGE

[75] Inventors: Hermann-Josef Klein, Landshut; Klaus Adam, Asperg; Juergen Wuerth, Freiberg, all of Fed. Rep. of Germany

[73] Assignee: Robert Bosch GmbH, Stuttgart, Fed. Rep. of Germany

[21] Appl. No.: 654,647

[22] PCT Filed: Aug. 5, 1989

[86] PCT No.: PCT/DE89/00515

§ 371 Date: Feb. 11, 1991

§ 102(e) Date: Feb. 11, 1991

[87] PCT Pub. No.: WO90/02873

PCT Pub. Date: Mar. 22, 1990

[30] Foreign Application Priority Data

Sep. 2, 1988 [DE] Fed. Rep. of Germany ..... 3829797

[51] Int. Cl.[5] ..... F02P 17/00; F02D 41/22; F02D 41/34

[52] U.S. Cl. ..... 123/481; 123/630; 324/388

[58] Field of Search ..... 123/198 DB, 198 F, 479, 123/481, 630; 73/117.3, 116; 324/399, 388

[56] References Cited

U.S. PATENT DOCUMENTS

| | | | |
|---|---|---|---|
| 4,117,807 | 10/1978 | Barnard | 123/630 X |
| 4,366,794 | 1/1983 | Hachiga et al. | 123/479 |
| 4,503,822 | 3/1985 | Kobayashi et al. | 123/416 |
| 4,512,316 | 4/1985 | Mochizuki | 123/478 |
| 4,887,574 | 12/1989 | Kuroiwa et al. | 123/435 X |
| 4,918,389 | 4/1990 | Schleupen et al. | 123/630 X |
| 4,987,771 | 1/1991 | Iwata | 73/117.3 |

FOREIGN PATENT DOCUMENTS

| | | | |
|---|---|---|---|
| 33939 | 8/1981 | European Pat. Off. . | |
| 171523 | 8/1987 | European Pat. Off. . | |
| 37241 | 4/1978 | Japan | 123/630 |
| 198377 | 10/1985 | Japan | 123/630 |

*Primary Examiner*—Tony M. Argenbright
*Attorney, Agent, or Firm*—Michael J. Striker

[57] ABSTRACT

A method of electronic engine control for a motor vehicle includes sensing an ignition voltage of a final ignition stage, effecting a performance check of the final ignition stage in response to a control signal generated in response to sensing the ignition voltage of a final ignition stage, and providing an error flag if the control signal deviates from a predetermined control signal. An apparatus for performing the foregoing method comprises an electric control circuit that includes a sensor for detecting the ignition voltage, and control means that effects a performance check in response to a sensor output signal and emits the error flag in response to an error control signal.

1 Claim, 2 Drawing Sheets

APPARATUS FOR ELECTRONIC ENGINE CONTROL WITH PERFORMANCE CHECK FOR THE FINAL IGNITION STAGE

BACKGROUND OF THE INVENTION

The invention relates to an apparatus for electronic engine control with a performance check for the final ignition stage and comprising an electrical control circuit for controlling the final ignition stage and/or fuel injection as a function of engine parameters such as engine temperature, engine speed, and the like.

Electronic engine control systems are known which comprise a processor which controls the engine operation taking into account various engine parameters. In particular, the optimal fuel injection quantity and the optimal ignition timing are determined as a function of engine speed, engine temperature, position of the accelerator pedal, and consideration of the characteristic diagrams of the specific engine. In the known engine controls, the engine parameters listed above are determined by suitable sensors. The engine speed can be determined, e.g., at the camshaft, the engine temperature can be determined by a thermal element, and the position of the accelerator pedal can be determined by a distance sensor or indirectly by an angle pickup which determines the position, of the throttle valve. Such an engine control is known, e.g., from DE-OS 35 41 731.

In motor vehicles whose exhaust system is equipped with a catalyst, unburned fuel can reach the catalyst in a faulty final ignition stage and destroy it while releasing extraordinarily high heat energy. There is a danger not only of the catalyst being destroyed, but even that the vehicle may catch on fire.

SUMMARY OF THE INVENTION

The object of the invention is an apparatus for electronic engine control in which the a failure of the final ignition stage is detected and a corresponding error flag is prepared. The object of the invention is achieved by arranging an ignition voltage detection sensor at at least one ignition cable leading away from the ignition coil and communicating the sensor output signal to CPU. The error flag can serve, on one hand, to activate an error display. However, it is preferable to use the error detection for switching off the fuel injection, wherein the fuel injection remains switched off until an error is no longer detected and a switching on of the fuel supply is permissible again while taking into account the respective engine operating state.

Since a switching-off of the fuel supply is generally not required with a single ignition failure, a further development of the invention provides that the error flag is fed to a counter as a counting pulse, and that the fuel injection is switched off when a predetermined reference counter state is reached. The reference counter state can be adapted to the exhaust system or to the construction type of the catalyst and engine, so that the fuel injection is switched off, e.g., only after five successively determined ignition failures. When the presence of the correct ignition voltage at the ignition cable is determined after switching off the fuel injection, the counter is reset and the fuel injection is switched on again. However, this is preferably effected only under the condition that a thrust cut-off caused by letting up on the accelerator pedal has been determined immediately beforehand. This condition has the advantage that no sudden switching on of the fuel injection and accordingly no unexpected acceleration is triggered. When turning on the fuel injection in the thrust cut-off operating state, the fuel injection is released, but an injection of fuel is prevented for the time being as long as the thrust cut-off operating state is maintained. Normal fuel injection is then effected only after renewed actuation of the accelerator pedal.

An inductive sensor is preferably arranged in the area of an ignition cable leading to a spark plug, the sensor output signal of the inductive sensor being converted into a rectangular pulse by a signal converter. This rectangular pulse can be digitally processed directly in the processor.

In ignition systems with a plurality of final ignition stages, as used in six- or eight-cylinder engines, a sensor and a counter are assigned to every final ignition stage in order to carry out a separate performance check for every final ignition stage.

DETAILED DESCRIPTION OF THE PREFERRED EMBODIMENT

Figure 1:
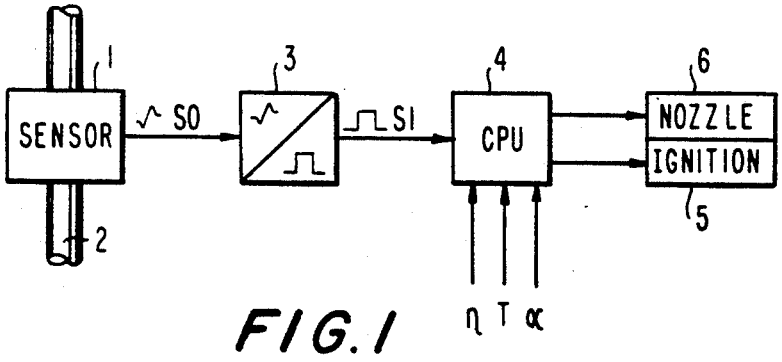
FIG. 1 shows a block wiring diagram basic construction of an apparatus for engine control engine control.

The block wiring diagram shown in FIG. 1 shows the basic construction of an apparatus for engine control with performance check for the final ignition stage. A sensor 1, which is assigned to an ignition cable 2, sends a sensor output signal SO at its output side when an ignition voltage occurs. The sensor output signal SO is converted into a rectangular signal SI in a signal converter 3 and is fed to the input of an engine control 4. The engine control in turn controls the injection system 5 and the ignition 6 of an internal combustion engine. The sensor 1 can likewise be arranged on the cable 30 between the ignition coil 11 and distributor 9. If the position of the distributor rotor arm 9 or crankshaft is known, the occurrence of an ignition voltage can be determined for every spark plug 8 with a single sensor in a manner directed specifically to the cylinder. If a determination relating to the specific cylinder is not important, the crankshaft position or position of the distributor rotor arm 9 need not be known. In this case, it is sufficient to observe the type of sensor signal SO.

Various parameters, such as rate of rotation n, engine temperature T, throttle valve angle, which characterize the respective operating state of the engine, are assigned to the engine control 4 which controls the engine while taking them into account. Characteristic lines and/or characteristic diagrams relating to the specific engine which are taken into account for the control tasks of the engine control memory are stored in the engine control. The control of engine operation with the aid of characteristic lines and characteristic diagrams is known per se and is not the subject matter of the present invention; therefore, a more involved description of the implementation of the engine control is not discussed here.

Figure 2:
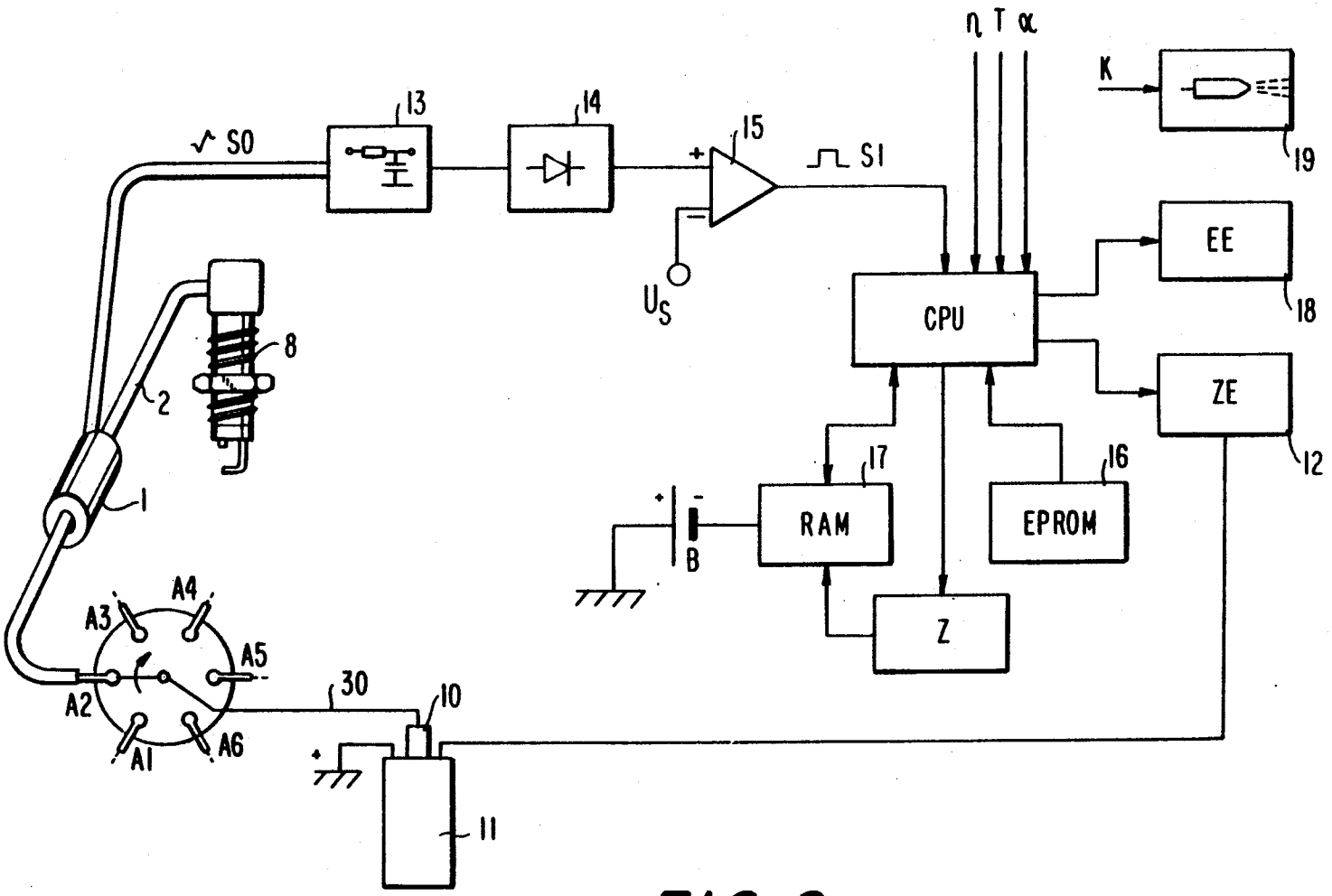
FIG. 2 shows a wiring diagram of the engine control with a final ignition stage.

A more detailed block wiring diagram with ignition devices is indicated in FIG. 2.

An induction sensor 1 encloses the ignition cable 2, which leads from an output of an ignition distributor 7 to a spark plug 8 or the cable 30. The ignition distributor 7 has a total of six outputs A1 to A6 which lead to a spark plug. A distributor rotor arm 9, connects the outputs A1 to A6 consecutively with the output 10 of an ignition coil 11 which is activated by a final ignition stage 12.

When an ignition voltage occurs at the ignition cable 2 or cable 30, the sensor 1 sends a sensor output signal SO to a filter 13 whose output is connected with the input of a rectifier 14. The output signal of the rectifier 14 is fed to the positive input of a differential amplifier 15 whose negative input is connected to a threshold value voltage Us. If the output signal of the rectifier 14 exceeds the voltage value of the threshold voltage Us, a positive voltage occurs at the output of the differential amplifier 15 until the output signal of the rectifier 14 falls below the value of the threshold value voltage Us again. Accordingly, a rectangular signal SI occurs at the output of the differential amplifier 15 when a sensor output signal SO occurs. The filter 13, the rectifier 14 and the differential amplifier 15 together form the signal converter 3, as is shown in FIG. 1.

The rectangular signal SI is fed to an input of a processor CPU which checks whether or not a rectangular signal SI also arrives via the final ignition stage 12 when an ignition voltage is triggered. Since a sensor 1 is arranged only at the ignition distributor output A2 in the present embodiment example, this check is only carried out when the distributor rotor arm 9 is located in the position shown in the drawing.

If the processor CPU determines during a computer-controlled engine control that the rectangular signal SI is not present at the required point in time, a counter Z which is connected to the processor CPU is increased by 1 with respect to its counter state. The current counter state is stored in a memory RAM connected with the counter Z and with the processor CPU. The memory RAM is battery-buffered, i.e. a battery B also protects the contents of the memory when the supply voltage of the engine control fails or is switched off.

Further, a read only memory 16 is connected to the processor CPU, in which a reference counter state which is constantly compared for agreement with the current counter state in the processor is stored. As soon as agreement is determined between the reference counter state and the current counter state, the processor sends an error flag to the battery-buffered memory 17. The fuel injection is switched off simultaneously with the error flag. This is effected in that the final injection stage 18, which is controlled by the processor CPU, is switched off, so that no more fuel K is injected into the combustion chamber of the engine by means of the injection nozzle 19 connected subsequently. As soon as the engine control again determines an error-free functioning of the ignition system, the final injection stage 18 can be reactivated, wherein this should be effected on condition that a release or activation of the final injection stage 18 may be effected after an error flag only in the "thrust cut-off" operating state.

Figure 3:
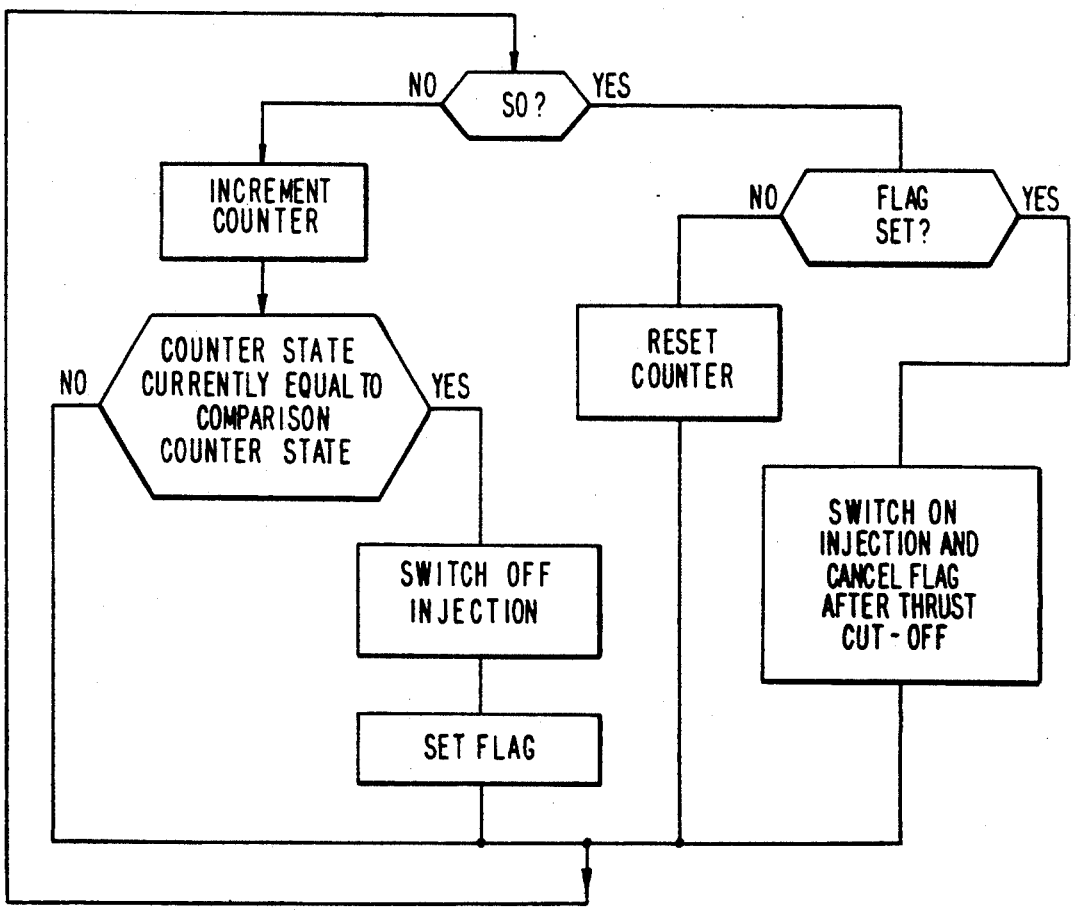
FIG. 3 shows a function diagram for the engine control shown in FIGS. 1 and 2.

The manner of operation of the control shown in FIG. 2 is explained in more detail with reference to the function diagram shown in FIG. 3.

The processor executes a constantly repeating routine in the performance check which begins by first checking whether or not a sensor output signal SO is present. The sensor output signal is absent when there is a disturbance in the final ignition stage 12 or the ignition devices connected subsequent to the latter, which results in an incrementing of the counter Z. The current counter state is then compared with the permanently stored, predetermined reference counter state. If the comparison is negative, the next cycle of the checking routine begins and the counter is possibly incremented again until the counter state is currently the same as the reference counter state. Since the reference counter state represents the maximum allowable error number, a switching-off of the injection is now effected, wherein an error light can be activated simultaneously. Moreover, a marker, which is usually designated as a flag, acts in the battery-buffered memory 17.

The checking routine is continued and the injection remains switched off until it is determined at the beginning of the checking cycle that a sensor output signal SO is present. Now the contents of the memory are first checked as to whether or not a flag is set. If so, the injection is turned on again and the flag is canceled, but only when the "thrust cut-off" operating state is determined, so that no unexpected sudden acceleration occurs for the driver.

If it is determined in a cycle of the checking routine that a sensor output signal is present and no flag is set, the counter 17 is reset or set to zero, respectively.

It is possible to have the checking routine not run or be ineffective under certain conditions, e.g., when a predetermined minimum engine temperature has not yet been reached. It can also be provided that no checking routine is carried out during the engine starting phase. An interruption of the checking routine can be provided during the thrust cut-off and/or during an acceleration enrichment, depending on the requirements.

While the invention has been illustrated and described as embodied in an apparatus for electronic engine control with performance check for the final ignition stage, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. An apparatus for electronic engine control, comprising an electrical control circuit for controlling a final ignition stage as a function of engine parameters including an engine speed and an engine temperature, said electrical control circuit including at least one sensor arranged at one of at least one ignition cable leading to spark plug means of the engine and a cable leading from an ignition coil to a distributor rotor arm, for detecting an ignition voltage and generating a control signal in response to activation of the final ignition stage, and control means for effecting a performance check of the final ignition stage in response to the control signal, said control means emitting an error flag when the control signal deviates from a predetermined control signal, said electrical control circuit also including a counter to which the error flag is fed as a counting pulse, fuel injection being switched off when a reference counter state is reached, said control means including a read-only memory for storing a reference counter state, and a battery-buffered memory for storing an actual counter state, the fuel injection being first switched on again when a thrust cut-off is effected by release of an accelerator pedal.

* * * * *